US005638626A

United States Patent [19]

Westrom

[11] Patent Number: 5,638,626

[45] Date of Patent: Jun. 17, 1997

[54] AMMUNITION MAGAZINE

[76] Inventor: Mark Westrom, 230 Cherry Ct., Silvis, Ill. 61282

[21] Appl. No.: 638,892

[22] Filed: Apr. 25, 1996

[51] Int. Cl.[6] ..... F41A 9/61

[52] U.S. Cl. ..... 42/50; 42/18; 42/22

[58] Field of Search ..... 42/18, 22, 50

[56] References Cited

U.S. PATENT DOCUMENTS

| | | | |
|---|---|---|---|
| 2,951,424 | 9/1960 | Stoner | 89/191 |
| 3,198,076 | 8/1965 | Stoner | 89/128 |
| 3,345,770 | 10/1967 | Scanlon, Jr. | 42/50 |
| 3,776,095 | 12/1973 | Atchisson | 89/128 |
| 4,058,922 | 11/1977 | Elbe et al. | 42/16 |
| 4,069,608 | 1/1978 | Jurek | 42/49 |
| 4,079,535 | 3/1978 | Elbe et al. | 42/49 |
| 4,098,016 | 7/1978 | Foote | 42/16 |
| 4,128,042 | 12/1978 | Atchisson | 89/138 |
| 4,169,329 | 10/1979 | Atchisson | 42/16 |
| 4,502,237 | 3/1985 | Krogh | 42/50 |
| 4,514,922 | 5/1985 | Farrar et al. | 42/50 |
| 4,617,749 | 10/1986 | Jurek | 42/16 |
| 4,653,210 | 3/1987 | Poff, Jr. | 42/16 |
| 4,664,015 | 5/1987 | Kennedy | 89/138 |
| 4,698,931 | 10/1987 | Larsson | 42/16 |
| 4,888,900 | 12/1989 | Howard | 42/50 |
| 5,279,059 | 1/1994 | Howard | 42/90 |
| 5,351,598 | 10/1994 | Schuetz | 89/185 |
| 5,357,703 | 10/1994 | Chesnut et al. | 42/50 |
| 5,473,834 | 12/1995 | Bammate | 42/50 |

*Primary Examiner*—J. Woodrow Eldred

*Attorney, Agent, or Firm*—Woodward, Emhardt, Naughton Moriarty & McNett

[57] ABSTRACT

A removable ammunition magazine has a body with a side wall. The body defines a passage sized to hold ammunition and an opening intersecting the passage. The opening is sized to pass ammunition therethrough and includes a notch in the side wall. A follower is moveably positioned within the passage for positioning beneath ammunition placed within the passage. A magazine spring yieldingly urges the follower toward the opening. A bolt catch actuator is coupled to the follower. The actuator includes an actuation finger carried with the follower and an activation spring in contact with the finger. The spring projects the finger through the notch when the follower is aligned with the notch. A fire arm with a magazine having a bolt catch actuation finger movable relative to the follower is also disclosed.

27 Claims, 4 Drawing Sheets

AMMUNITION MAGAZINE

BACKGROUND OF THE INVENTION

The present invention relates to fire arm magazines, and more particularly relates to magazines configured to actuate a catch mechanism on a fire arm.

Ammunition magazines are commonly employed to hold a number of rounds of ammunition and feed each round to a chamber in a gun for subsequent firing. One type of magazine has a spring-loaded follower positioned along a passage. Ammunition is loaded into the passage on top of the follower with the associated spring positioned beneath the follower in a compressed state. Typically, this arrangement successively urges each round loaded on top of the follower into the gun chamber.

Sometimes it is desirable to hold a bolt or slide of a gun firing mechanism in an open position to inspect the chamber after all rounds supplied by a magazine have been fired. This arrangement not only permits inspection of the chamber, but also notifies the marksman that the magazine is empty. One type of fire arm has a catch which may be actuated by a fixed protrusion on a follower of an attached magazine. Once actuated, this catch holds the firing mechanism open after all the rounds have been fired. U.S. Pat. Nos. 4,069,608 to Jurek and 4,888,900 to Howard generally describe magazines of this kind.

Usually, magazines of this kind must be configured with extra space to accommodate fixed follower protrusions prior to actuation. Also, these magazines are often designed with longitudinal slots and grooves to facilitate fixed protrusion travel along the magazine. Typically, these structural aspects complicate magazine manufacture and add cost. Thus, a need remains for a cost effective magazine actuator having an actuator which preferably occupies less space when inactive. The present invention satisfies this need.

SUMMARY OF THE INVENTION

One feature of the present invention is a magazine with an actuator that moves relative to the motion of a follower mechanism associated with the magazine. This actuator may be used to activate a fire arm catch.

Another feature is a removable ammunition magazine, which includes a magazine body with a side wall. The body defines a passage sized to hold ammunition and an opening intersecting the passage. The opening is sized to pass ammunition therethrough and includes a notch in the side wall. A follower is moveably positioned within the passage for positioning beneath ammunition placed within the passage. A magazine spring yieldingly urges the follower toward the opening. The body retains the magazine spring in the passage. A bolt catch actuator is coupled to the follower. The actuator includes an actuation finger carried with the follower and an activation spring in contact with the finger. The spring projects the finger through the notch when the follower aligns with the notch.

In one implementation of this feature the follower defines a chamber to house the spring loaded actuation finger. This configuration minimizes the space occupied by the finger before actuation because a substantial portion of the finger may be retained within the follower.

A further feature of the present invention is a gun with a magazine configured to activate a bolt catch. The gun includes a receiver defining a loading chamber. The receiver also has a bolt with an open position to load a round into the loading chamber and a closed position to secure a loaded round for firing. The receiver further includes a bolt catch to hold the bolt in the open position when all rounds have been expended.

For this feature, the magazine removably engages the receiver and has a body defining a passage intersected by an aperture. The passage holds multiple rounds, and each round consecutively passes through the aperture. The body has a side wall defining an opening intersecting the passage. A follower is movably positioned within the passage and urges each round in the passage through the aperture. The follower has an actuation position in the passage between the opening and the aperture. A bolt catch actuator is coupled to the follower and carried therewith. The actuator includes a spring-loaded finger that extends through the opening when the follower is in the actuation position and contacts the bolt catch to hold it open after all rounds in the passage are expended.

Still another feature of the present invention is a removable ammunition magazine having a body with a mounting end opposing a base end. The body defines a passage with an aperture at the mounting end and an opening in a side wall also intersecting the passage. A follower is moveably positioned within the passage and has a path of travel from a first position to a second position along the passage. The second position is closer to the mounting end than the base end. The follower is positioned beneath ammunition placed within the passage. A magazine spring yieldingly urges the follower toward the aperture. A gun actuator is coupled to the follower and carried therewith. The actuator includes a finger that is contained within the body when the follower is in the first position. The finger moves relative to the follower to project through the opening when the follower is in the second position. In one version of this feature, the finger is integral to the magazine spring.

Accordingly, one object of the present invention is to provide a removable ammunition magazine with a finger movable relative to a follower to selectively activate a fire arm catch.

Another object of the present invention is to provide a fire arm having a magazine with a spring-loaded finger to actuate a catch mechanism.

Still another object of the present invention is to provide a cost effective ammunition magazine with an actuator.

Further advantages, features, and objects of the present invention will be apparent from the drawings and discussions herein.

DESCRIPTION OF THE PREFERRED EMBODIMENT

Figure 1:
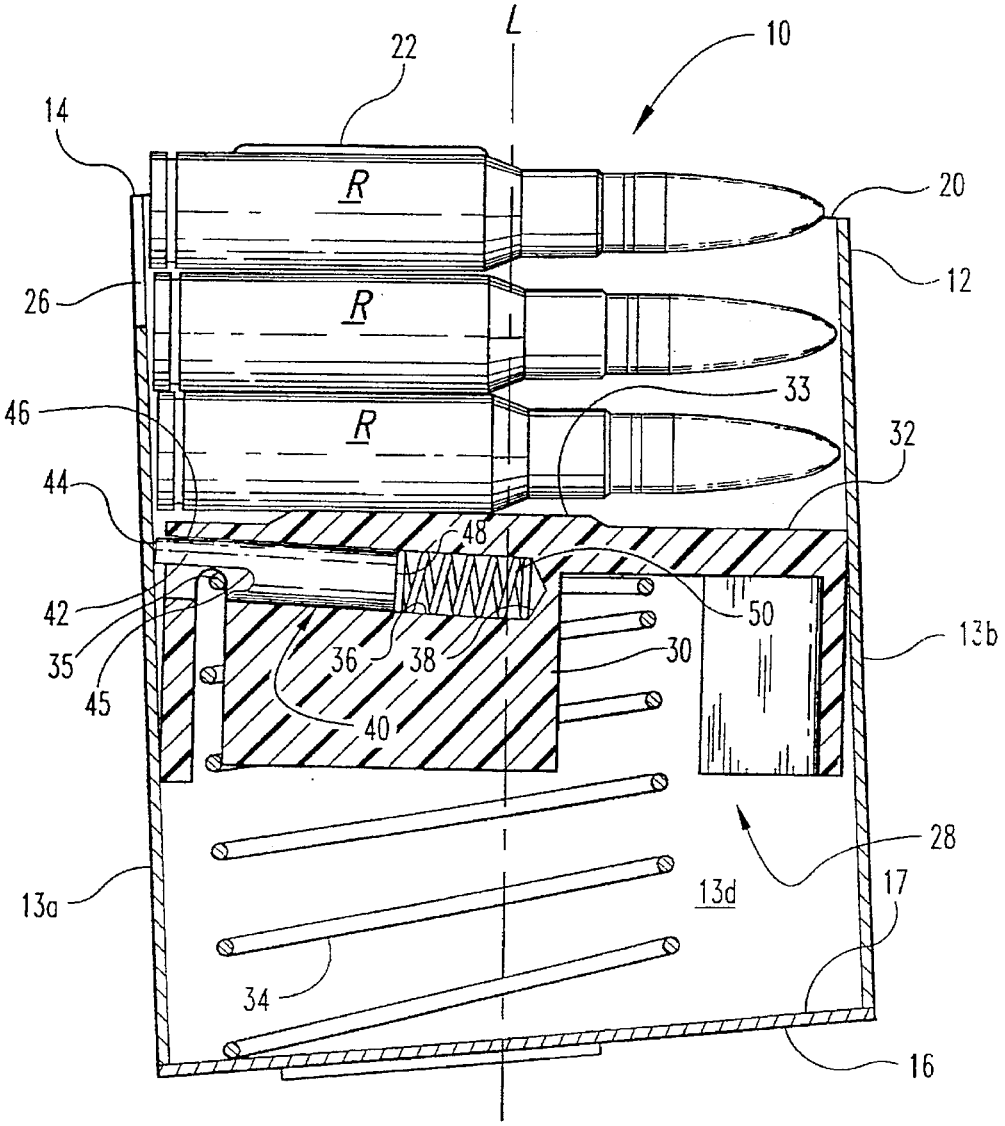
FIG. 1 is a cross-sectional side view of a partially loaded magazine of one preferred embodiment of the present invention.
Figure 2:
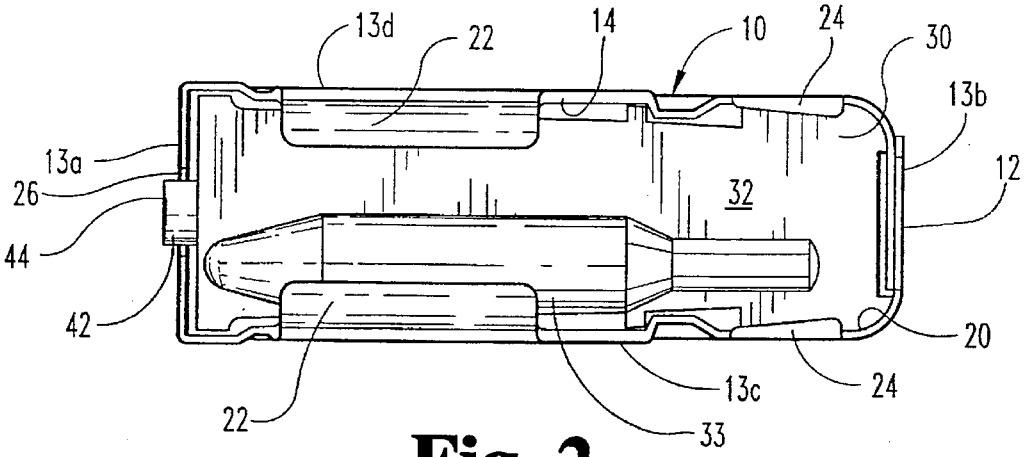
FIG. 2 is a top plan view of the magazine of FIG. 1 in an unloaded position.
Figure 4:
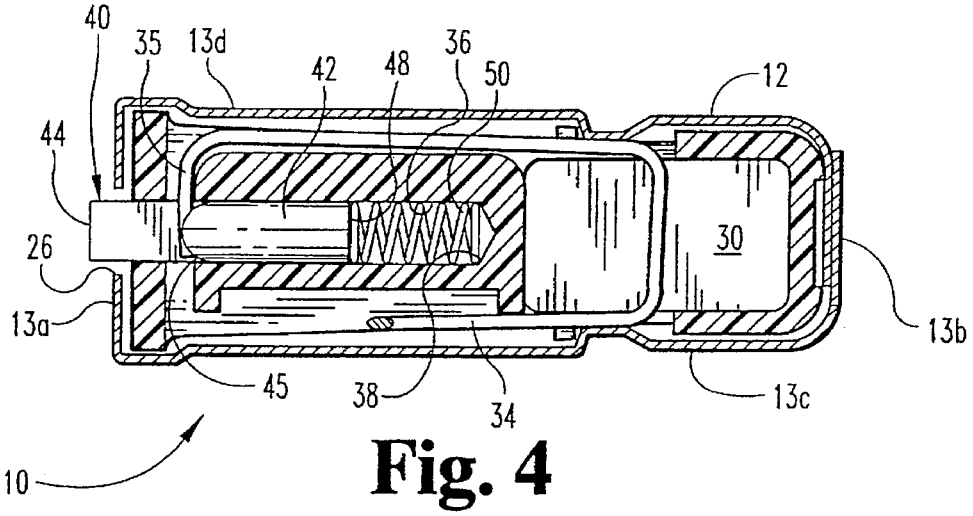
FIG. 4 is a bottom cross-sectional view of the magazine shown in FIG. 3.
Figure 3:
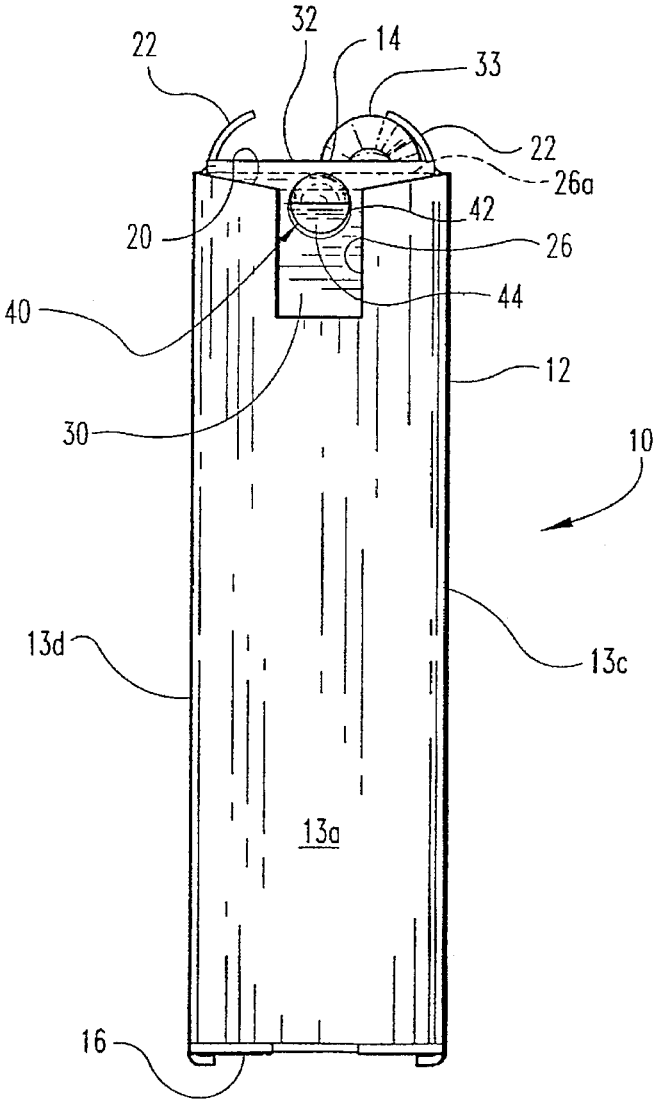
FIG. 3 is an elevational rear view of the magazine shown in FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any alterations and further modifications in the described device, and any further applications of the principles of the invention as described herein are contemplated as would normally occur to one skilled in the art to which the invention relates.

FIGS. 1 through 4 depict magazine 10 of one preferred embodiment of the present invention. Magazine 10 has a body 12 with opposing side walls 13*a*, 13*b* joined by opposing side walls 13*c*, 13*d*. Side walls 13*a*, 13*b*, 13*c*, and 13*d* extend along longitudinal axis L from mounting end 14 to opposing base end 16 of body 12. Base end 16 includes floor 17. A generally rectangular cross-section is formed by body 12 along axis L. Preferably, body 12 is made from metal, however, other materials such as composites, thermoplastics, and thermoset compounds may be used.

Body 12 defines orifice 20 at mounting end 14. Orifice 20 is bordered by opposing feed lips 22. Body 12 also has tabs 24. A notch 26 is defined by side wall 13*a* and intersects orifice 20. Orifice 20 and notch 26 have a common rim. Passage 28 is defined within body 12 and intersects orifice 20 and notch 26. Passage 28 houses follower 30 therein. Follower 30 includes platform 32 with biasing bulge 33. Bulge 33 assists with the feeding of cartridges R loaded in magazine 10 one by one through orifice 20. Magazine spring 34 yieldingly urges platform 32 towards orifice 20. As such, follower 30 is configured to move along passage 28 with magazine spring 34. Follower 30 and magazine spring 34 are retained within passage 28 by tabs 24 of body 12 and contact of bulge 33 with feed lips 22.

Follower 30 defines a chamber 36 having a spring bearing surface 38. Chamber 36 houses at least a portion of actuator 40. Actuator 40 is carried along with follower 30 on magazine spring 34. Preferably, follower 30 is made from a thermoplastic compound and magazine spring 34 is formed from metal.

Actuator 40 includes finger 42. Finger 42 is depicted as an elongate bar with first end 44 opposing second end 48. Finger 42 is configured with contact surface 46 adjacent first end 44. Correspondingly, chamber 36 is configured as an elongate bore receiving at least a portion of finger 42. This portion includes second end 48 of finger 42. Preferably, finger 42 is made of metal.

Actuator 40 also includes coil spring 50 nested between spring bearing surface 38 and second end 48 of finger 42. Actuator 40 is configured so that finger 42 projects through notch 26 via force provided by compression spring 50 when follower 30 is aligned between notch 26 and orifice 20. Preferably, second end 48 of finger 42 is retained within chamber 36 when finger 42 is extended through notch 26 by stop 45 defined along finger 42. Stop 45 engages upper arm 35 of magazine spring 34 to prevent spring 50 from propelling finger 42 out of chamber 36 entirely. Spring 50 is preferably formed from metal.

Figure 5:
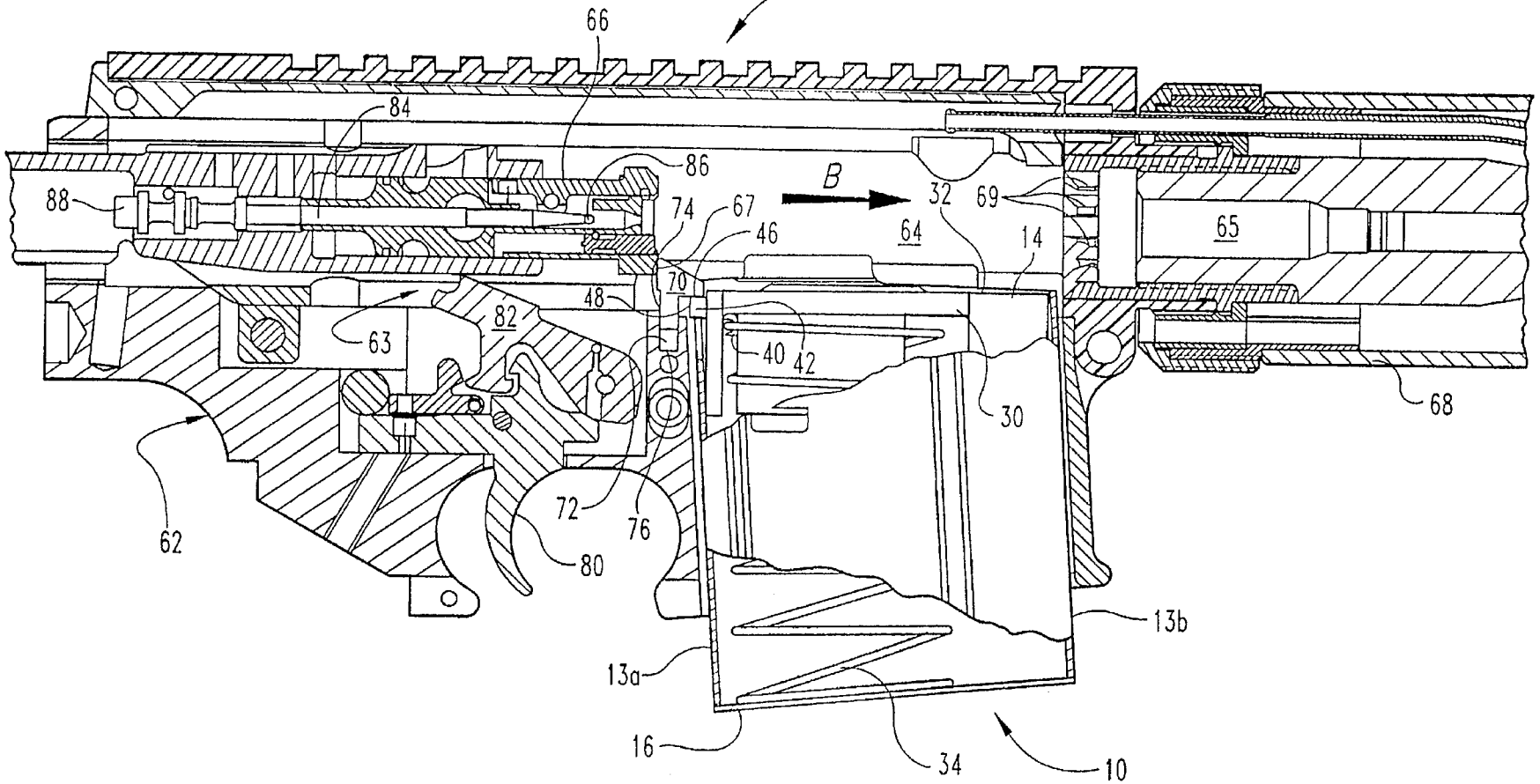
FIG. 5 is a cut-away side view of the magazine of FIGS. 1–4 shown coupled to a gun. The gun is depicted in schematic cross-section.

Referring to FIG. 5, magazine 10 is shown coupled to gun 60 in a conventional manner. Gun 60 has receiver 62 defining loading chamber 64. Loading chamber 64 intersects chamber 65 and is adjacent barrel 68 of gun 60. Also, the firing mechanism 63 of gun 60 includes sliding bolt 66 in receiver 62 shown in FIG. 5 in an open position. In the closed position, bolt 66 slides within receiver 62 and rotates to interlock with lugs 69 shown adjacent firing chamber 65. Receiver 62 also has bolt catch 70 shown holding bolt 66 in the open position by contact with catch surface 67 of bolt 66. Catch 70 is configured to slide along slot 72 defined by receiver 62. Contact surface 46 of finger 42 is shown in contact with bolt catch 70, holding bolt catch 70 in an actuated position in the upper portion 74 of slot 72. When catch 70 is not actuated or activated, it is rests in lower portion 76 of slot 72.

The firing mechanism 63 of gun 60 also includes trigger 80 and hammer 82 each pivotably mounted to receiver 62. Firing pin 84 is positioned within bolt 66 and is configured to move therein. Firing pin 84 has a firing end 86 opposing hammer end 88.

One mode of operation of the present invention is next discussed. Referring to FIG. 1, magazine 10 is shown loaded with a number of rounds of ammunition depicted as cartridges R. Follower platform 32 is positioned beneath cartridges R and magazine spring 34 positioned beneath platform 32 to urge the cartridges R toward orifice 20. Finger 42 of actuator 40 is retained within body 12 with first end 44 bearing against wall 13*a* under pressure provided by compressed spring 50. At least a portion of finger 42 slidingly engages chamber 36 and second end 48 of finger 42 abuts spring 50 compressed in chamber 36. This compressed spring 50 stores energy later used to move finger 42.

Referring additionally to FIG. 5, magazine 10 is shown after all cartridges R have been expended. The loading and firing of cartridges R from magazine 10 occurs in a conventional manner and may be automatic or semi-automatic. U.S. Pat. Nos. 2,951,424 to Stoner, 3,198,076 to Stoner, and 5,351,598 to Schuetz provide further information pertinent to this process. Generally, this process begins when a cartridge is fed into loading chamber 64 while bolt 66 is in the open position, but before bolt catch 70 is activated. Once a cartridge is loaded into loading chamber 64, bolt 60 then slides forward along arrow B to move the cartridge into firing chamber 65. Bolt 66 rotates and interlocks with lugs 69 as it moves forward.

A cartridge in firing chamber 65 is fired when trigger 80 is pulled by a marksman. This pulling motion causes trigger 80 to rotate which in turn causes hammer 82 to rotate. Rotation of hammer 82 results in hammer 82 striking hammer end 88 of firing pin 84. Consequently, firing pin 84 moves within bolt 66 so that firing end 86 of firing pin 84 impacts the cartridge, causing it to fire.

Once a cartridge is fired, bolt 66 slides back to the open position opposite the direction indicated by arrow B and extracts the spent shell with an extractor (not shown) before another cartridge is loaded into loading chamber 64 from magazine 10. This process of consecutively firing and loading proceeds for each of cartridges R at the discretion of the shooter.

As cartridges R are consecutively expelled through passage 28 and orifice 20, magazine spring 34 moves and gradually expands toward orifice 20. Follower 30 correspondingly moves from a loaded position near base end 16 to an empty position adjacent orifice 20. Actuator 40 rides along with follower 30 and magazine spring 34, and finger 42 correspondingly slides against side wall 13*a*. However, once most cartridges are expelled, follower 30 is near mounting end 14, and spring 50 projects finger 42 through notch 26. As finger 42 extends through notch 26, it should be noted that is moving relative to follower 30 and magazine spring 34. Also, for the depicted embodiment, spring 50 propels finger 42 in a different direction than the motion of follower 30 through passage 28.

Preferably, finger 42 slides through notch 26 and under bolt catch 70 when bolt catch 70 is resting in lower portion 76 of slot 72. As the remaining cartridges R in magazine 10 are expelled, contact surface 46 of extended finger 42 contacts bolt catch 70 and correspondingly moves it along slot 72 in response to motion of follower 30 and magazine spring 34. As bolt catch 70 moves along with follower 30, stop 45 notably prevents separation of finger 42 from magazine 10 in cooperation with upper arm 35 of magazine spring 34.

Once the magazine is empty, the follower reaches its empty position and bolt catch 70 correspondingly reaches upper portion 74 of slot 72. When bolt 66 slides back after firing this final round, bolt catch 70 engages catch surface 67 of bolt 66 to hold bolt 66 in the open position after expending the last round. This position notifies the shooter that all rounds have been extracted and provides for inspection.

To use magazine 10 again, magazine 10 is uncoupled from gun 60, finger 42 is depressed into chamber 36, and additional cartridges are loaded onto follower platform 32. Magazine spring 34 is gradually compressed and follower 30 moves further away from orifice 20 as the cartridges are loaded. Eventually, finger 42 will once again be retained within passage 28. This reloaded magazine 10 may then be recoupled to gun 60 to fire the newly loaded rounds.

In other embodiments of the present invention, magazine 10 and any of its various components may be manufactured of other materials or reconfigured as would occur to one skilled in the art. For example, spring 50 may be replaced by a leaf spring of a known type. In one alternative embodiment, finger 42 and spring 50 are replaced by a single integral spring loaded finger component. In this embodiment, the need for a stop may be eliminated by anchoring the end of the spring loaded finger to the follower. Similarly in other embodiments, the finger and spring may include additional components interspersed therebetween.

In another alternative embodiment, actuator 40 is not housed within a chamber 36 of follower 30 but is otherwise connected to follower 30, magazine spring 34, or both. Similarly, finger 42 and actuator 40 may be variously sized, shaped, and otherwise reconfigured to accommodate various other types of firing mechanisms or gun catches, such as slides common to some pistols. In one embodiment, the magazine is configured to hold no more than 10 rounds to comply with government regulations. For this embodiment, finger 42 protrudes through notch 26 when at least one round is left in the magazine.

In still another embodiment, an opening defined by side wall 13*a* is used in place of notch 26. This opening intersects passage 28, but does not necessarily share a rim with orifice 20. In one variation of this embodiment, material bridges the top of notch 26 (see element 26*a* in phantom in FIG. 3 indicating where such alternative material may be located).

Figure 7:
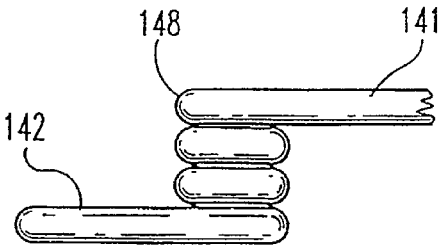
FIG. 7 is a partial top view of the magazine shown in FIG. 6.
Figure 6:
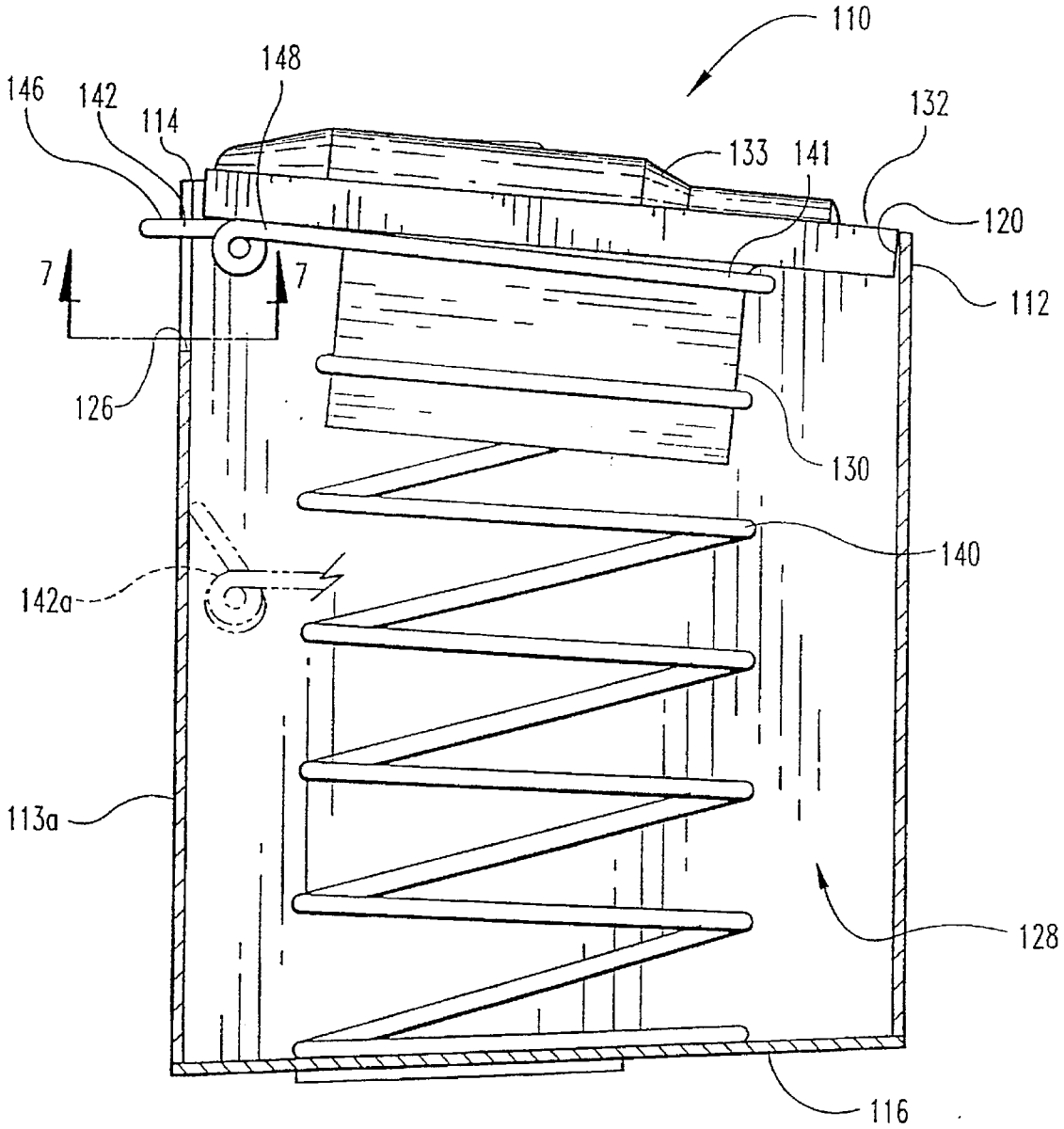
FIG. 6 is a cross-sectional side view of a magazine of another preferred embodiment of the present invention.

Referring to FIGS. 6 and 7, another type of magazine 110 of the present invention is illustrated. Similar to magazine 10, magazine 110 has body 112 with mounting end 114 opposing base end 116. An aperture 120 is defined at mounting end 114 to load and unload cartridges therethrough. Similarly, follower 130 and magazine spring 140 are configured to move along passage 128 defined by body 112. Follower 130 has a platform 132 defining a biasing protrusion 133 to assist with feeding of cartridges to a gun one by one.

Magazine spring 140 has upper arm 141 with a finger portion 142 connected thereto. Finger portion 142 is restrained within body 112 until follower 130 approaches aperture 120 and aligns with opening 126 defined in wall 113*a*. When so aligned, finger portion 142 of magazine spring 140 extends through opening 126 to provide actuation similar to finger 42 of magazine 10. Spring hinge 148 is integrally formed from spring arm 141 to extend finger portion 142 through opening 126. Finger portion 142 has a contact surface 146 to contact a gun catch. Finger portion 142 moves relative to follower 130 and magazine spring 140 to project through opening 126 when follower 130 aligns in an actuation position between aperture 120 and opening 126.

Finger portion 142 may be elastically deformed to be restrained within passage 128 prior to alignment with opening 126. The restrained position of finger portion 142 is shown in phantom as portion 142*a*. This elastically restrained position would occur when magazine 110 is loaded with cartridges on platform 132 and magazine spring 140 is correspondingly compressed. As these cartridges are expelled through aperture 120, restrained finger portion 142 moves along wall 113*a* until opening 126 is reached at which time, under the influence of integral spring hinge 148, finger 142 projects through opening 126 to contact a catch to provide desired actuation. Like magazine 10, magazine 110 may be adapted and reconfigured in various ways as would occur to one skilled in the art without departing from the spirit of the present invention.

All publications, patents, and patent applications cited in this specification are herein incorporated by reference as if each individual publication, patent or patent application were specifically and individually indicated to be incorporated by reference.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A removable ammunition magazine, comprising:

a magazine body with a side wall, said body defining a passage sized to hold ammunition and an opening intersecting said passage, said opening being sized to pass ammunition therethrough and including a notch in said side wall;

a follower moveably positioned within said passage, said follower being configured for positioning beneath ammunition placed within said passage;

a magazine spring yieldingly urging said follower toward said opening, said body being configured to retain said magazine spring in said passage; and a bolt catch actuator coupled to said follower and including:

an actuation finger carried with said follower, an activation spring in contact with the finger, said spring projecting said finger through said notch when said follower is positioned within said passage to align with said notch.

2. The magazine of claim 1, wherein said body has a pair of opposing tabs to retain said follower within said passage, and said body has a pair of opposing feeding lips formed about said opening.

3. The magazine of claim 1, wherein said body has a longitudinal axis, said passage lies along said longitudinal axis and has a generally rectangular cross section therealong.

4. The magazine of claim 1, wherein said finger is configured to extend through said notch when at least one round remains in said passage.

5. The magazine of claim 1, wherein said follower defines an elongate bore and said finger includes an elongate bar slidably engaging said bore.

6. The magazine of claim 1, wherein:

said activation spring includes an elongate coil;

said finger is configured with an elongate bar having a first end opposing a second end, said first end being configured to extend through said notch and said second end being in contact with said activation spring; and said follower has a spring bearing surface and is configured to retain said activation spring between said second end of said finger and said spring bearing surface.

7. The magazine of claim 6, wherein:

said body is formed from metal along a longitudinal axis, and said body has a pair of opposing tabs to hold said follower and said magazine spring within said passage, and said body has a pair of opposing feeding lips formed about said opening;

said follower defines an elongate chamber, said chamber containing said activation spring; and said finger includes a stop engaged by said magazine spring to retain at least a portion of said finger within said chamber, said portion including said second end.

8. A gun, comprising:

a receiver defining a loading chamber and including:

a bolt having an open position to load a round into said loading chamber and a closed position to secure a loaded round for firing, a bolt catch, said bolt catch being configured to hold said bolt in said open position;

a multiple round magazine removably engaging said receiver and including:

a magazine body defining a passage intersected by an aperture, said passage being sized to hold multiple rounds and said aperture being sized to consecutively pass each round therethrough, said body having a side wall defining an opening intersecting said passage;

a follower movably positioned within said passage, said follower being configured to urge each round in said passage through said aperture, said follower having an actuation position in said passage between said opening and said aperture;

a bolt catch actuator coupled to said follower and carried therewith, said actuator including a spring-loaded finger, said finger being configured to extend through said opening when said follower is in said actuation position, and contact said bolt catch to hold said bolt catch open after all rounds in said passage are expended.

9. The gun of claim 8, wherein said receiver includes:

a firing pin movably positioned within said bolt;

a trigger pivotally mounted to said receiver, said trigger being configured for selective motion by a marksman; and a hammer pivotally mounted to said receiver, said hammer being configured to rotate in response to motion of said trigger to strike said firing pin and translationally move said firing pin within said bolt to shoot a loaded round impacted by said firing pin.

10. The gun of claim 8, wherein said opening intersects said aperture and said finger is configured to extend through said opening when at least one round remains in said passage.

11. The gun of claim 8, wherein said bolt catch is configured to move in response to movement of said follower within said passage when said finger contacts said bolt catch.

12. The gun of claim 11, wherein said bolt catch is configured to move along a slot defined in said receiver.

13. The gun of claim 8, wherein said follower includes: a follower platform configured for positioning beneath ammunition loaded in said passage, and further comprising a magazine spring positioned within said passage beneath said follower platform adapted to urge said follower platform toward said aperture.

14. The gun of claim 8, wherein said spring loaded finger includes:

a coil spring; and an elongate bar with a first end opposing a second end, said first end being configured to extend through said opening to contact said bolt catch and said second end being in contact with said coil spring.

15. The gun of claim 14, wherein:

said body has a pair of opposing tabs to hold said follower within said passage, and said body has a pair of opposing feeding lips formed about said aperture;

said follower defines a chamber containing said coil spring and said second end of said elongate bar; and said elongate bar has an upper contact surface configured to contact said bolt catch.

16. In combination, an apparatus comprising:

a magazine configured to hold and dispense a number of rounds of ammunition, said magazine including:

a magazine body defining a passage intersected by an orifice, said passage being sized to hold the number of rounds of ammunition, said orifice being sized to pass each round in said passage therethrough, said body having a side wall defining an opening intersecting said passage;

a follower positioned within said passage and configured for positioning beneath the number of rounds contained in said passage to urge each of the number of rounds through said orifice, said follower having an actuation position between said opening and said orifice;

a catch actuator coupled to said follower and configured to move therewith, said actuator including a finger, said finger being configured to move relative to said follower, said finger being configured to project through said opening when said follower is in said actuation position; and a gun defining a loading chamber in communication with said passage, said loading chamber being configured to receive each of the number of rounds of ammunition from said magazine for firing, said gun including a catch actuated by contact with said finger extending through said opening.

17. The apparatus of claim 16, wherein said opening intersects said orifice and said finger is configured to extend through said opening when at least one round remains in said passage.

18. The apparatus of claim 16, wherein said catch is configured to move in response to movement of said follower within said passage when said finger contacts said catch.

19. The apparatus of claim 16, wherein said follower includes a follower platform configured for positioning beneath ammunition loaded in said passage, and further comprising a magazine spring positioned within said passage beneath said follower platform to urge said follower platform toward said orifice.

20. The apparatus of claim 19, wherein:

said finger is spring-loaded and has an elongate bar with a contact surface configured to contact said catch;

said follower platform defines a chamber, said elongate bar having a stop configured to engage said magazine spring adjacent said follower platform to retain at least a portion of said elongate bar in said chamber; and said body has a pair of opposing tabs to hold said follower within said passage, and said body has a pair of opposing feeding lips formed about said orifice.

21. The apparatus of claim 16, wherein said gun includes a a receiver defining said loading chamber, and said receiver has a bolt with an open position to load a round into said loading chamber and a closed position to secure a loaded round for firing, said catch being configured to hold said bolt in said open position when all rounds of ammunition in said magazine are expended.

22. A removable ammunition magazine, comprising:

a magazine body with a mounting end opposing a base end, said body defining a passage with an aperture at said mounting end, said passage being sized to hold ammunition and said aperture being sized to pass ammunition therethrough, said magazine having a side wall defining an opening intersecting said passage;

a follower moveably positioned within said passage, said follower having a path of travel from a first position to a second position along said passage, said second position being closer to said mounting end than said base end, said follower being configured for positioning beneath ammunition placed within said passage; and a magazine spring yieldingly urging said follower toward said aperture, said body being configured to retain said magazine spring in said passage;

a bolt catch actuator configured to move along with magazine spring and said follower, said actuator including a finger configured to be contained within said body when said follower is in said first position, and said finger moving relative to said follower to project through said opening when said follower is in said second position.

23. The magazine of claim 22, wherein said finger of said bolt catch actuator is a portion of said magazine spring.

24. The magazine of claim 22, wherein said body has a pair of opposing feeding lips formed about said aperture.

25. The magazine of claim 22, wherein said body has a longitudinal axis, said passage lies along said longitudinal axis and has a generally rectangular cross section therealong.

26. The magazine of claim 22, wherein said opening intersects said aperture and said finger is configured to extend through said opening when at least one round remains in said passage.

27. The magazine of claim 22, wherein:

said bolt catch actuator includes a coil spring;

said finger is configured with an elongate bar having a first end opposing a second end, said first end being configured to extend through said opening and said second end being in contact with said coil spring; and said follower has a spring bearing surface and is configured to retain said coil spring between said second end and said spring bearing surface.

* * * * *

UNITED STATES PATENT AND TRADEMARK OFFICE

CERTIFICATE OF CORRECTION

PATENT NO. : 5,638,626

DATED : June 17, 1997

INVENTOR(S) : Mark A. Westrom

It is certified that error appears in the above-indentified patent and that said Letters Patent is hereby corrected as shown below:

On the title page, in "Attorney, Agent or Firm", please change "Woodward" to --Woodard--.

In column 4, line 5, please delete, "is", second occurrence.

In column 9, line 14, please delete "a", first occurrence.

Signed and Sealed this

Twenty-eighth Day of October, 1997

*Attest:*

*Attesting Officer*

BRUCE LEHMAN

*Commissioner of Patents and Trademarks*